US008296885B2

(12) United States Patent
Rie

(10) Patent No.: US 8,296,885 B2
(45) Date of Patent: Oct. 30, 2012

(54) COMFORTABLE BED PREVENTING BED SORES FOR INVALIDS AND SLEEP DISTURBING PATIENT

(76) Inventor: Jin Rie, Los Angeles, CA (US)

( * ) Notice: Subject to any disclaimer, the term of this patent is extended or adjusted under 35 U.S.C. 154(b) by 297 days.

(21) Appl. No.: 12/804,261

(22) Filed: Jul. 19, 2010

(65) Prior Publication Data

US 2010/0287702 A1 Nov. 18, 2010

Related U.S. Application Data

(63) Continuation-in-part of application No. 12/319,694, filed on Jan. 12, 2009, now abandoned.

(51) Int. Cl.
*A47B 7/00* (2006.01)

(52) U.S. Cl. ..... 5/604; 5/200.1; 5/424; 5/430

(58) Field of Classification Search ..... 5/604–606, 5/200.1, 424, 425, 428, 430, 695, 722, 727, 5/731, 732, 739, 663; 4/450, 455, 456, 547
See application file for complete search history.

(56) References Cited

U.S. PATENT DOCUMENTS

| | | | |
|---|---|---|---|
| 4,953,246 | A | 9/1990 | Matthews |
| 5,052,065 | A | 10/1991 | West |
| 5,054,136 | A | 10/1991 | Inagaki |
| 5,193,232 | A | 3/1993 | Flood et al. |
| 5,317,768 | A | 6/1994 | Klancnik |
| 5,331,698 | A | 7/1994 | Newkirk et al. |
| 5,355,540 | A | 10/1994 | Allen |
| 5,524,640 | A | 6/1996 | Lisak et al. |
| 5,577,279 | A | 11/1996 | Foster et al. |
| 5,592,705 | A | 1/1997 | West |
| 5,604,943 | A | 2/1997 | Kimura et al. |
| 5,680,661 | A | 10/1997 | Foster et al. |
| 5,708,997 | A | 1/1998 | Foster et al. |
| 5,911,654 | A | 6/1999 | Webb |
| 5,933,888 | A | 8/1999 | Foster et al. |
| 6,112,345 | A | 9/2000 | Foster et al. |
| 6,272,702 | B1 | 8/2001 | Uchida et al. |
| 6,374,436 | B1 | 4/2002 | Foster et al. |
| 6,453,491 | B1 | 9/2002 | Wells et al. |
| 6,543,068 | B1 | 4/2003 | Penninger |
| 6,594,835 | B2 | 7/2003 | West |
| 6,615,426 | B1 | 9/2003 | Risk, Jr. |
| 6,622,323 | B2 | 9/2003 | Zerhusen et al. |
| 6,694,548 | B2 | 2/2004 | Foster et al. |
| 6,725,474 | B2 | 4/2004 | Foster et al. |
| 6,802,088 | B1 | 10/2004 | Gruner |
| 6,928,673 | B2 | 8/2005 | Risk, Jr. |
| 6,931,684 | B1 | 8/2005 | Henegar |
| 7,047,991 | B2 | 5/2006 | Kline |
| 7,076,817 | B1 | 7/2006 | Garver |
| 7,107,635 | B2 | 9/2006 | Henry et al. |
| 2005/0217026 | A1 | 10/2005 | Ramirez |
| 2005/0235418 | A1 | 10/2005 | Jacques et al. |

*Primary Examiner* — Robert G Santos
*Assistant Examiner* — Nicholas Polito

(57) ABSTRACT

A comfortable bed is provided. The bed is comprised of one head panel, one foot panel, two side support panels, one bed plate, one removable key-hole shape panel, and two side bottom frames. The two side support panels are comprised of a rigid wood portion and a soft resilient portion. The resilient portion is comprised of a smooth rounded "W" shaped soft rubbery material such as poly-urethane or silicone rubber. The soft resilient portion allows the user to lean his/her hand or leg with comfort and help the user fall asleep easily. A key hole shape panel and groove developed on the bed plate helps the user when excretion is needed with help of an assistant.

3 Claims, 7 Drawing Sheets

COMFORTABLE BED PREVENTING BED SORES FOR INVALIDS AND SLEEP DISTURBING PATIENT

This application is a continuous in part of the application Ser. No. 12/319,694, which was filed on Jan. 12, 2009 and is now abandoned.

FIELD OF THE INVENTION

Current application relates to a bed, especially to a bed that has side support plates to enable a user fall asleep easily.

BACKGROUND OF THE INVENTION

In spite of so many different types of bed on the market, including hospital bed, no bed is equipped with a function of providing comfortable, safe and helping user fall asleep easily. The applicant had a grandfather who suffered long time for his old age related sickness. So the applicant's grandfather has to stay on the bed for couple of years. But hospitals do not want to keep him therein due to his old age. And the applicant's grandfather wants to end his life with his family. So, the applicant's uncles should bring him to his house and took care of him for couple of years. Since the applicant's grandfather is in bed, he was suffered from the decubitus due to long time stay on the bed. And it was very hard for the grandfather to get sleep. The applicant searched many different type of beds that can be used for a weak seniors like his grandfather. But, most of the bed for patients is too much expensive and too much complex to be operated by an average people. In addition to that, those beds are not designed for patients who should stay there for long extended time. It is the purpose of the current application to provide a bed that is comfortable, safe and helps a user get asleep easily. And economically affordable at the same time.

DESCRIPTION OF THE PRIOR ARTS

U.S. Patent Application 20050235418 by Jacques, William L. II; et al. illustrates a bed enclosure for a health care facility bed including a frame and a mattress to support a patient. U.S. Patent Application 20050217026 by Ramirez, Elizabeth illustrates a device with a support for a mattress to accommodate a person on the mattress which includes a frame work including connectors to secure the framework in upstanding relation peripherally about the mattress. U.S. Pat. No. 7,107,635 to Henry et al., illustrated a fitted bed sheet having a pair of roll guards mounted thereon to prevent a toddler or other person from rolling out of bed. U.S. Pat. No. 7,076,817 to Garver illustrates a convalescent bed for safely restraining a bedridden patient includes a bed frame with a mattress that is raised and lowered by a hydraulic or electric lifting arm. U.S. Pat. No. 7,047,991 to Kline illustrates a bed enclosure comprising a frame, a tent supported by the frame, and a mattress cover is disclosed. U.S. Pat. Nos. 6,594,835, 5,592,705 and 5,052,065 to West illustrates an impact-cushioning device, which is designed to prevent injury when an occupant, confused or otherwise, falls from a height. U.S. Pat. No. 6,931,684 to Henegar illustrates a bed provided with a mattress having a removable insert; the insert incorporates an opening therein to receive a seat. U.S. Pat. Nos. 6,928,673 and 6,615,426 to Risk, Jr. discloses a side rail apparatus for a side rail of a hospital bed is provided that is coupled to the side rail. U.S. Pat. No. 6,802,088 to Gruner discloses a portable bed device comprising a horizontal bottom surrounded by vertical walls with an open top forming a tub for holding water therein. U.S. Pat. Nos. 6,725,474, 6,694,548, 6,374,456, 6,112,345, 5,933,888, 5,708,997, 5,680,661, and 5,577,279 to Foster, et. al. illustrates a hospital bed transformable to a chair that is movable from one place to other place via wheels. The movable hospital bed has a pivoting footboard half. U.S. Pat. No. 6,622,323 to Zerhusen, et al. illustrates a bed side rail for a bed having a frame includes a flexible section to allow a portion of the side rail to flex upward. U.S. Pat. No. 6,543,068 to Penninger discloses a portable bed-bath and shower device. U.S. Pat. No. 6,453,491 to Wells, et al. illustrates a safety bed including a wooden bed frame which supports a mattress, a footboard attached to one lateral side of said support structure, a headboard disposed at an opposing end of said support structure, and a pair of lateral side rails interconnecting the foot-board and the headboard on opposing sides of the bed frame. U.S. Pat. No. 6,272,702 to Uchida, et al. illustrates a multifunction bed that has a simple structure to allow its size to be reduced and that can be automatically changed between a bed form and a wheelchair form. U.S. Pat. No. 5,911,654 to Webb illustrates a cover and cushion ensemble for a hospital bed. U.S. Pat. No. 5,604,943 to Kimura, et al. illustrates a bed system with an excreting mechanism. U.S. Pat. No. 5,524,640 to Lisak, et al. illustrates an infant supporting and positioning system for retaining and supporting an infant in a selected position. The supporting system includes a horizontally oriented base which has a primary surface in which is formed a plurality of bores. The system includes a plurality of infant positioning modules each of which have a body portion and at least one post projecting from the body portion. U.S. Pat. No. 5,355,540 to Allen illustrates a bed for patients requiring bed treatment having a cut out in the base beneath which is a toilet pan. U.S. Pat. No. 5,331,698 to Newkirk, et al. illustrates a mattress for a birthing bed has three bladders inserted within a foam slab. U.S. Pat. No. 5,317,768 to Klancnik illustrates a mattress having a top surface component and a spring component. The top surface component comprises multiple layers. The first layer is the cover material for enveloping the entire mattress. The second layer is a fiber material covering the entire top surface of the mattress. The third layer is convoluted foam subtending the fiber layer and having a plurality of peaks for supporting the fiber layer in a no load condition. The fourth layer is a backing material for the convoluted foam layer. The peaks of the convoluted foam layer compress either completely or partially when a weight is applied and return to their original no load position when the weight is removed. U.S. Pat. No. 5,193,232 to Flood, et al. illustrates a collapsible bed-pan support or pad for bed-ridden persons. U.S. Pat. No. 5,054,136 to Inagaki illustrates a bed capable of allowing a patient such as the aged confined in a bed to take a bath easily and without much trouble to a nurse attending to the patient. According to a feature of the bed, a bath-tub is slidably mounted at the lower portion of the bed, the bath-tub having a mat disposed therein, said mat being movable up and down within the bath-tub with a human body laid thereon. The bed is provided with a tilting mechanism for easily transferring a patient from the bed to the mat, the mat also capable of being tilted by a suitable mechanism so that the human body may be easily transferred from the mat to the bed. U.S. Pat. No. 4,953,246 to Matthews illustrates a cubicle bed for protectively confining a traumatically brain injured patient or the like.

However, none of the prior art illustrates a comfortable bed that prevents bed sores for invalids and sleep disturbing patient.

SUMMARY OF THE INVENTION

In spite of so many different types of bed on the market, including hospital bed, no bed is equipped with a function of providing comfortable, safe and helping user fall asleep easily. The applicant had a grandfather who suffered long time for his old age related sickness. So the applicant's grandfather has to stay on the bed for couple of years. But hospitals do not want to keep him therein due to his old age. And the applicant's grandfather wants to end his life with his family. So, the applicant's uncle should bring him to his house and took care of him for couple of years. Since the applicant's grandfather is in bed, he was suffered from the decubitus due to long time stay on the bed. And it was very hard for him to get sleep. The applicant searched many different type of beds that can be used for a weak seniors like his father. But, most of the bed for patients is too much expensive and too much complex to be operated by an average people. In addition to that, those beds are not designed for patients who should stay there for long extended time. It is purpose of the current application to provide a bed that is comfortable, safe and helps a user get asleep easily. And economically affordable at the same time. The comfortable bed according to current invention is comprised of one head panel, one foot panel, two side support panels, one bed plate, one removable key-hole shape panel, and two side bottom frames. The two side support panels are comprised of a rigid wood portion and a soft resilient portion. The resilient portion is comprised of a smooth rounded "W" shaped soft rubbery material such as poly-urethane or silicone rubber. The soft resilient portion allows the user to lean his/her hand or leg with comfort and help the user fall asleep easily. A key hole shape panel and groove developed on the bed plate helps the user when excreting is needed with help of an assistant.

BRIEF DESCRIPTION OF THE DRAWINGS

FIG. 4 is a perspective drawing that shows the key hole shape panel and the groove there of.

DETAILED DESCRIPTION OF THE PREFERRED EMBODIMENT

Figure 1:
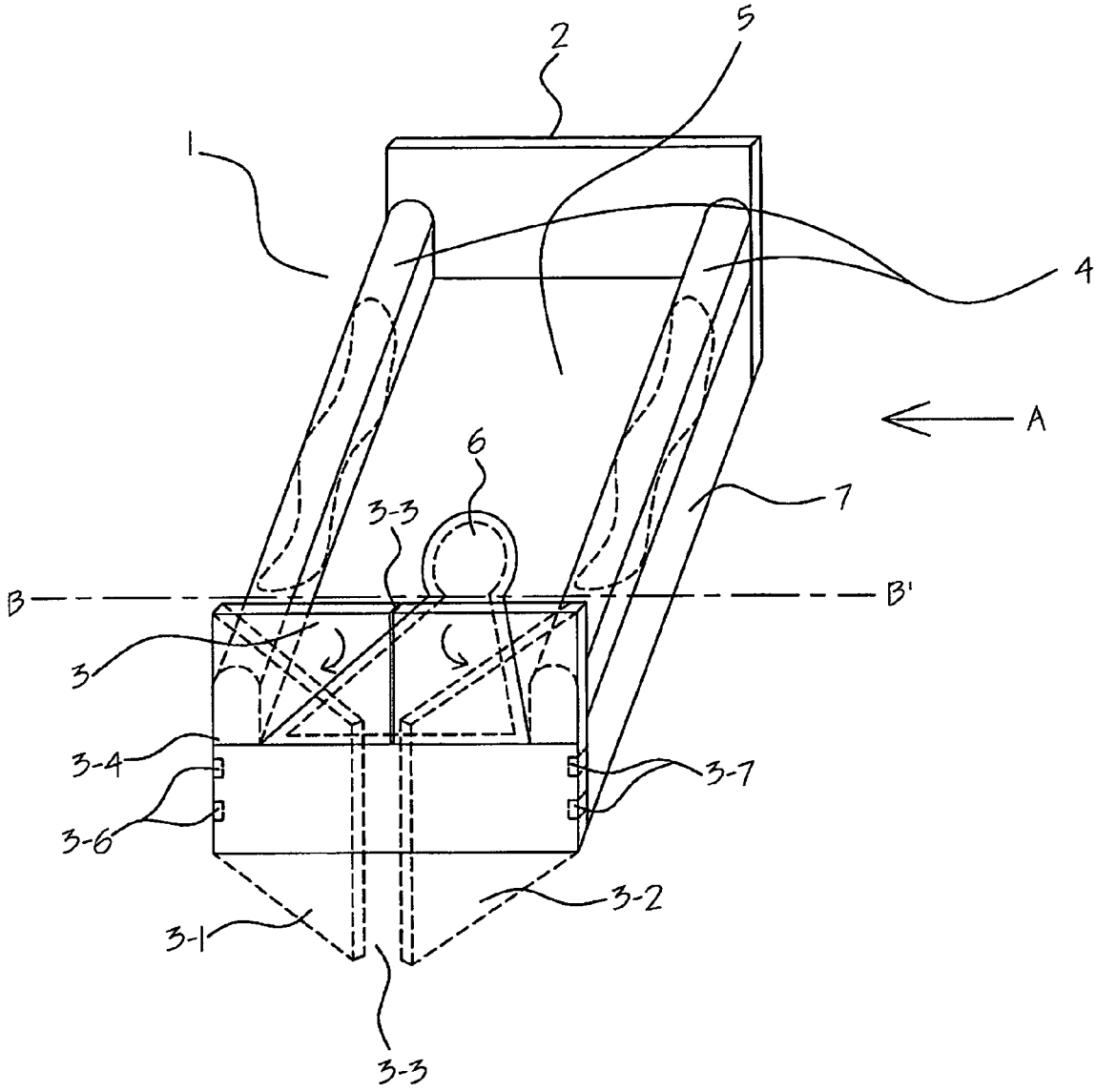
FIG. 1 is a perspective view of a comfortable bed according to current application.

FIG. 1 is a perspective view of a comfortable bed (1) according to current application. The bed (1) is comprised of one head panel (2), one foot panel (3), two side support panels (4), one bed plate (5), one removable key-hole shape panel (6), and two side bottom frames (7). All of the panels (2), (3), (4), plate (5) and frames (7) are made of, including but not limited to, wood.

The purpose of current application is to provide a comfortable bed that prevents bed sores for invalids and sleep disturbing patients at the same time. The two side support panels (4) provide those functions.

Figure 2:
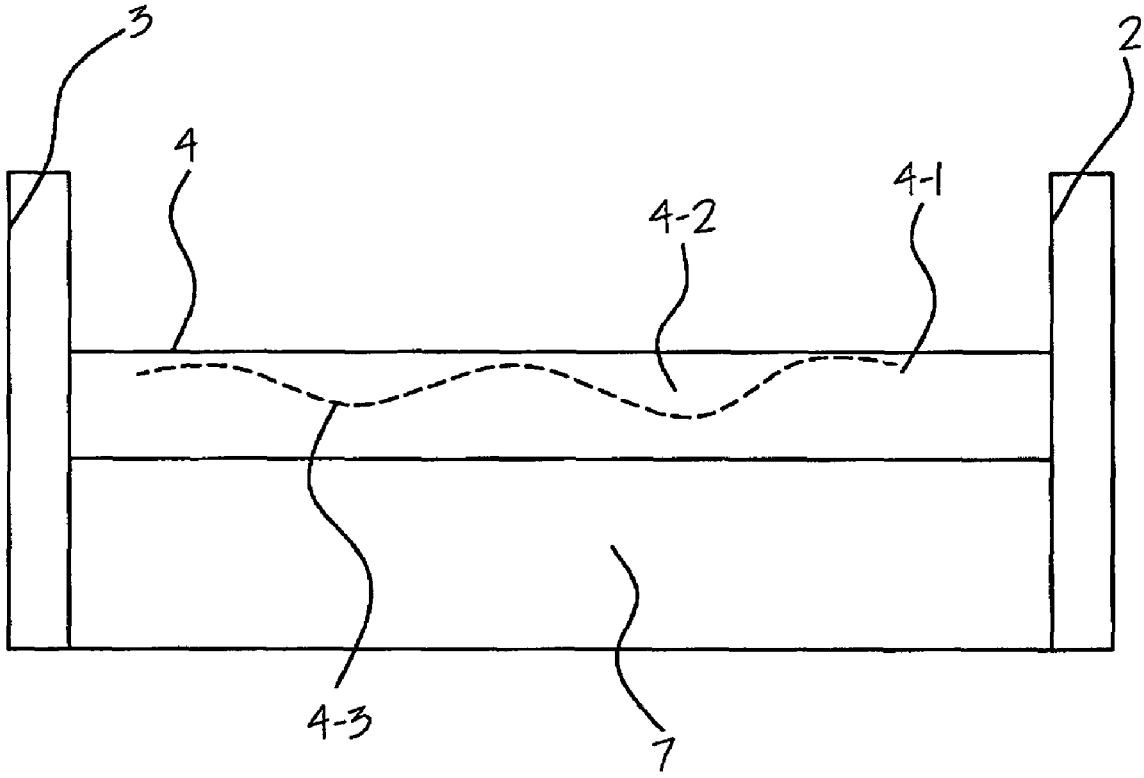
FIG. 2 is a side view of the comfortable bed according to current application seen from the view point A in FIG. 1.

FIG. 2 is a side view of the comfortable bed (1) according to current application seen from the view point A in FIG. 1. The side support panels (4) of the bed (1) is comprised of a rigid wood portion (4-1) and a soft resilient portion (4-2). Each upper surface of the rigid wood portion of the side support panel (4) is curved as a smooth rounded wide "W" shape (4-3). Each lower surface of the resilient portion (4-2) of the side support panel (4) is curved with the same smooth rounded wide"W" shape (4-3) of the solid wood portion (4-1) to meet with the upper surface of the solid wood portion (4-1) of the side support panel (4). The upper surface of the resilient portion (4-2) of the support panel (4) is formed as flat along the length and rounded as hemi-circle along the width. The resilient portion (4-2) of the side support panel (4) is made of a soft rubbery material such as poly-urethane or silicone rubber. Surface of the side support panels (4-2) are covered with soft textile, leather or artificial leathers.

Figure 3:
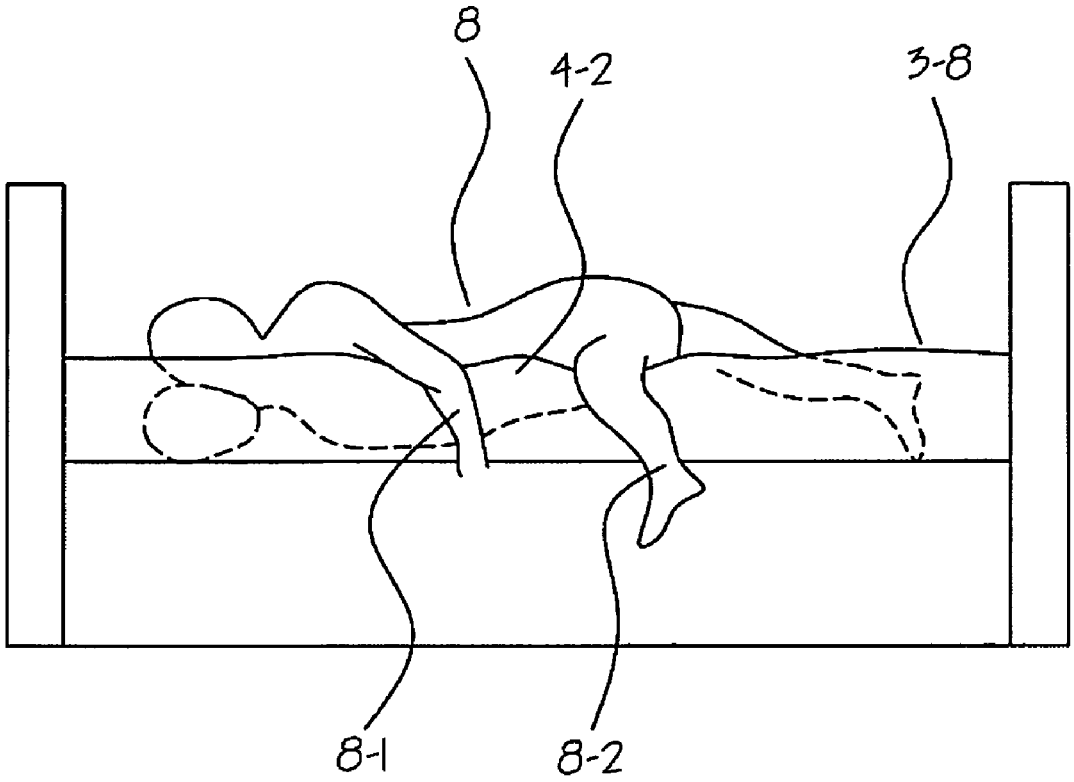
FIG. 3 is a schematic drawing that shows how the resilient portion make a user falls asleep easily.

In the FIG. 1 to 3 of the U.S. Pat. No. 5,317,768 to Klancnik, he disclosed a cross-sectional view of the mattress. The mattress has a fiber layer [16] and a foam layer [18]. The fiber layer [16] is not a rigid wood part.

FIG. 3 is a schematic drawing that shows how the resilient portion (4-2) helps a user (8) fall asleep easily. Many people experienced that it is very comfortable to put a hand or leg put on a some soft object when he/she tries to fall asleep. Sometimes, people use a pillow or blanket for that purposes. But, none of the bed on the market comes with such kind of comfortable functions. The soft resilient portion (4-2) allows the user (8) to lean his/her hand (8-1) or leg (8-2). This position makes the user feel like sleep on 'Mother's body' and helps the user fall asleep fast. At the same time, this position prevents bed sore by allowing the user sleep in a different position safely. If the user is a long term patient that should be in bed for an extended time, the bed of the current application will provide a bed sore preventing function. Also prevents the decubitus by allowing the patient lie side way with the help of the support.

Figure 4:
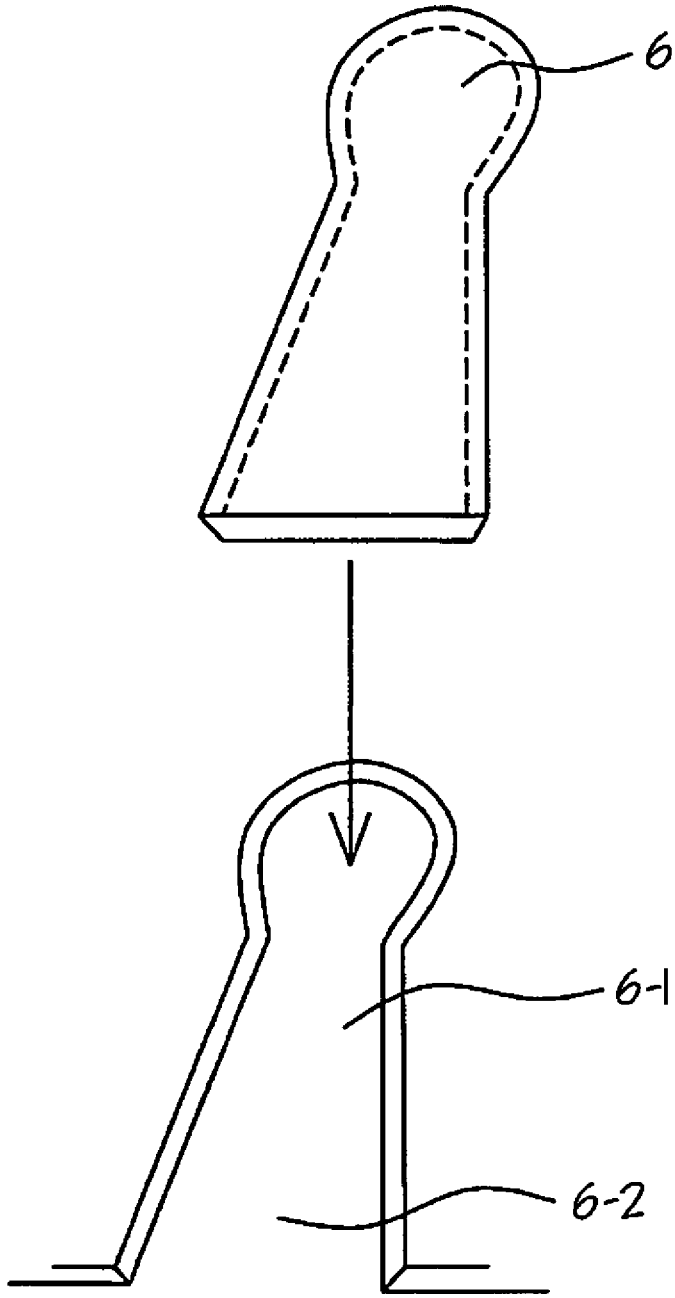

FIG. 4 is a perspective drawing that shows the key hole shape panel (6) and the groove (6-1) developed on the bed plate (5). The key-hole shape groove (6-1) is developed on the foot portion of the bed plate (5). The key hole shape panel (6) is comprised of the same material that constitutes the bed plate (5).

Figure 5:
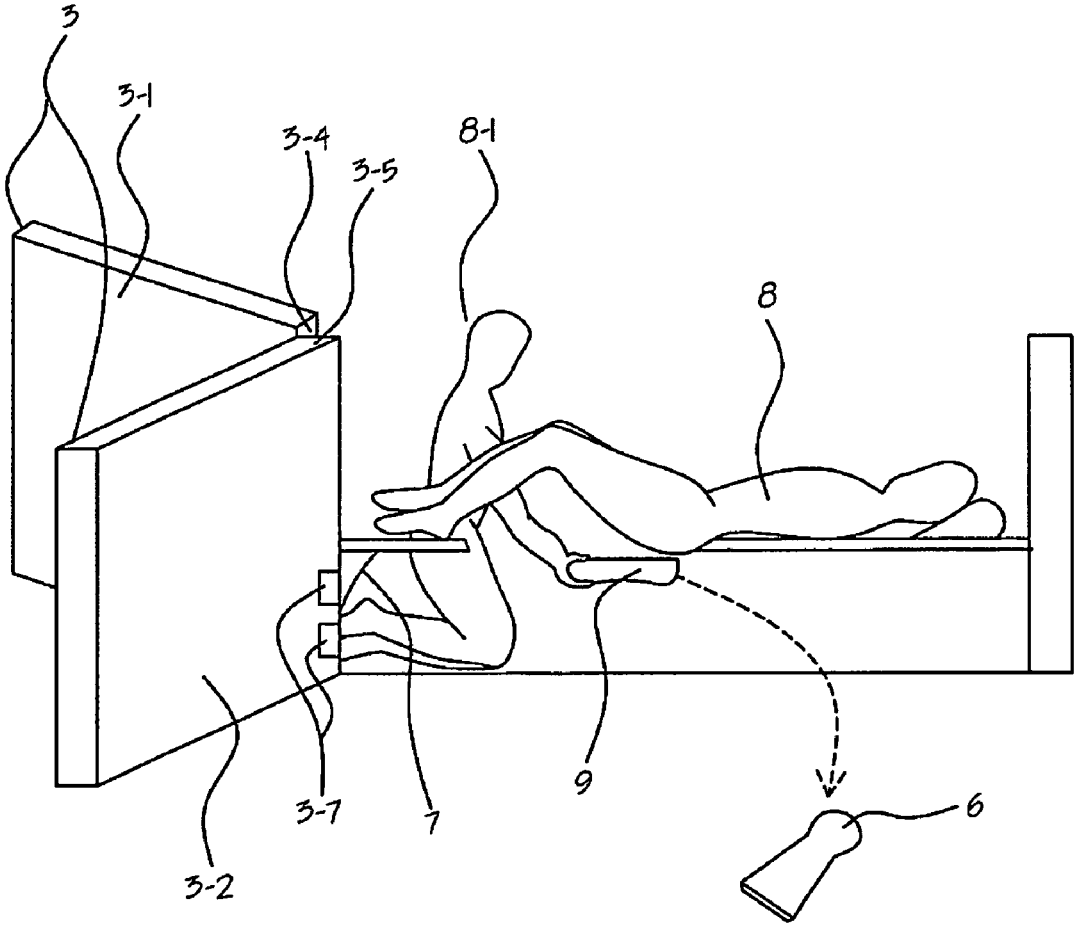
FIG. 5 is a schematic drawing that shows how the key hole shape panel is used.

FIG. 5 is a schematic drawing that shows how the key hole shape panel (6) is used. The foot panel (3) is comprised of two pieces (3-1), (3-2) that can be open from the center (3-3) (shown in the FIG. 1). One end of each piece (3-4), (3-5) is foldably attached to the bottom frame (7) via pluralities of hinges (3-6), (3-7) (refer to FIG. 1). In normal situation, the foot panel (3) is closed and the bottom portion (3-9) of the foot panel (3) touches the floor on which the bed is placed to support the bottom portion (3-9) of the bed (1) firmly.

In a series of U.S. Pat. Nos. 6,725,474 to 5,577,279 to Foster, et. al. illustrate a series of hospital bed that is transformable to a chair and is movable from one place to other place via wheels. The movable hospital bed has a pivoting footboard half [50]. The pivoting footboard half [50] is pivotally connected to the main frame [14], which is hydraulically lifted from the floor. Therefore, the footboard half [50] of Foster, et al's can not support the bottom portion of the bed solidly to the floor. Instead, the footboard half [50] is used as a handle or side support rail.

When the user (8) is very sick and need some help for excretion, an assistant (8-1) opens the foot panel (3), removes the key hole shape pane (6), get into the wide portion of the groove (6-2) (refer the FIG. 4), let the user open legs, and place an excrete tool (9) beneath the bottom of the user (8) to receive the excreta from the user (8).

From the above explanation, it is clear that a user (8) who is very weak and should be on bed for long time can avoid bed sore and can treat the excreta without moving out of the bed.

Meanwhile, Inagaki's U.S. Pat. No. 5,054,136 shows a bed provided with an evacuation device capable of forming an opening substantially in the central portion of the bed by moving a partitioning mat [45]. This partitioning mat may be slid a fixed distance automatically or manually from an opening [47] formed in a foot board [46] as shown in the FIG. 1 of that patent. However, it is impossible for an assistant to access to a patient and hold an excreting tool manually before the assistant crawl beneath the bed. Therefore, the comfortable bed of the current invention is much easy to operate and cheap compared to Inagaki's invention.

Figure 6:
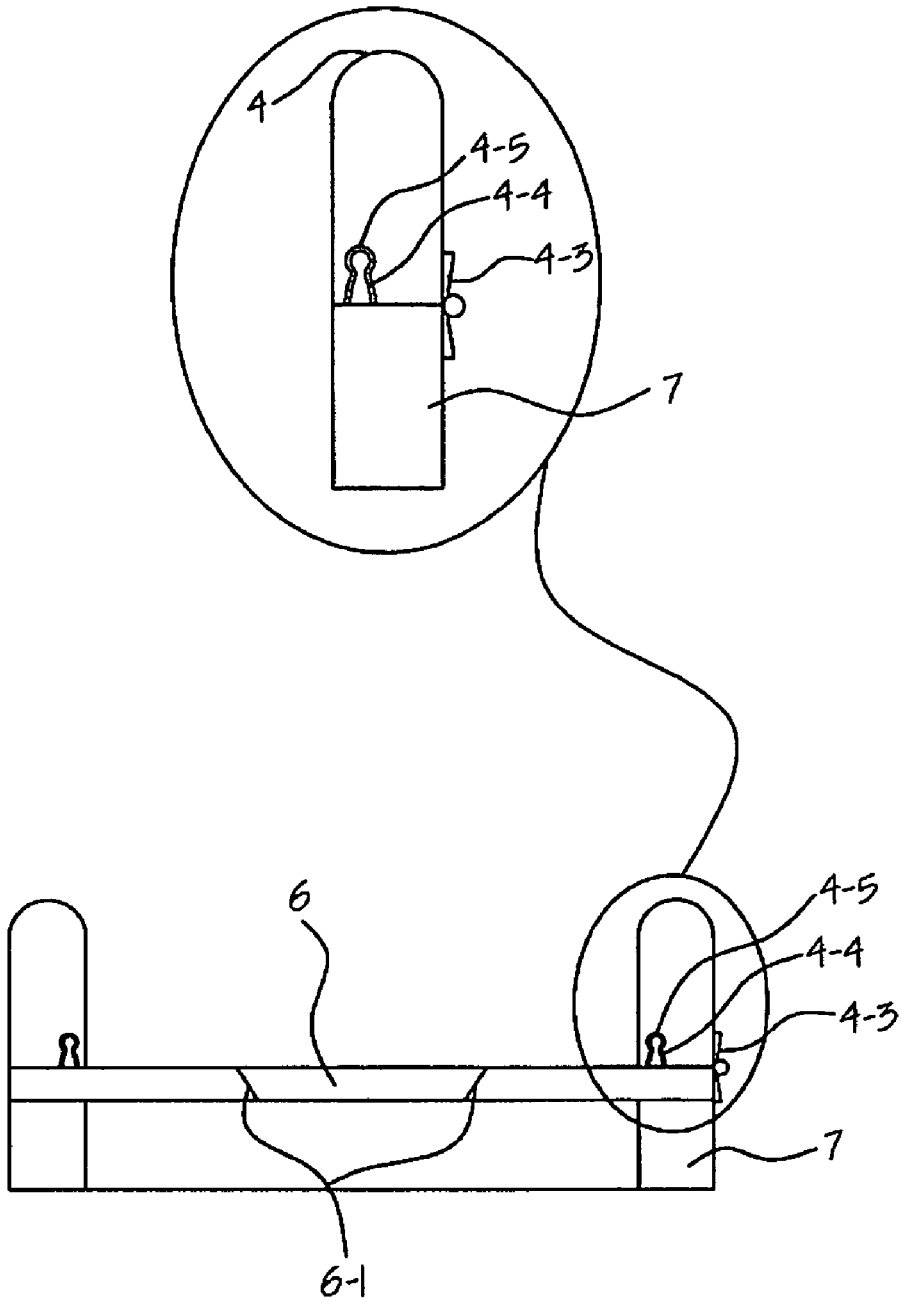
FIG. 6 is a cross sectional view of the bed seen from the B-B' cut away line showing the folding mechanism of the side support panels.

FIG. 6 is a cross sectional view of the bed (1) seen from the B-B' cut away line showing the folding mechanism of the side support panels (4). When the user (8) is recovered a little bit and wants to sit up, one side of the support panel (4) can be folded down to allow the user sit up on one side of the bed (1). The other extreme case is when the user is passed away and need to be removed from the bed (1), fold down one of the side support panel (4) will make it easy to remove the user (8)'s body from the bed (1).

For that function, outer side of the side support panel (4) is connected to the side bottom frames (7) with pluralities of hinges (4-3). Pluralities of protruding pins (4-4) are fixed on the upper surface of one side bottom frame (7) and pluralities of grooves (4-5) are developed on the lower surface of each of the side support panel (4). The protruding pins (4-4) have a ball shape head mounted on a conical bottom. The groove (4-5) has bore that match to the shape of the pins (4-4). This ball on top of a conical structure enables the pin (4-4) and groove (4-5) engage and disengages smoothly without breaking while one side of the side support panel (4) is connected to the side bottom frames (7) with pluralities of hinges (4-3).

Figure 7:
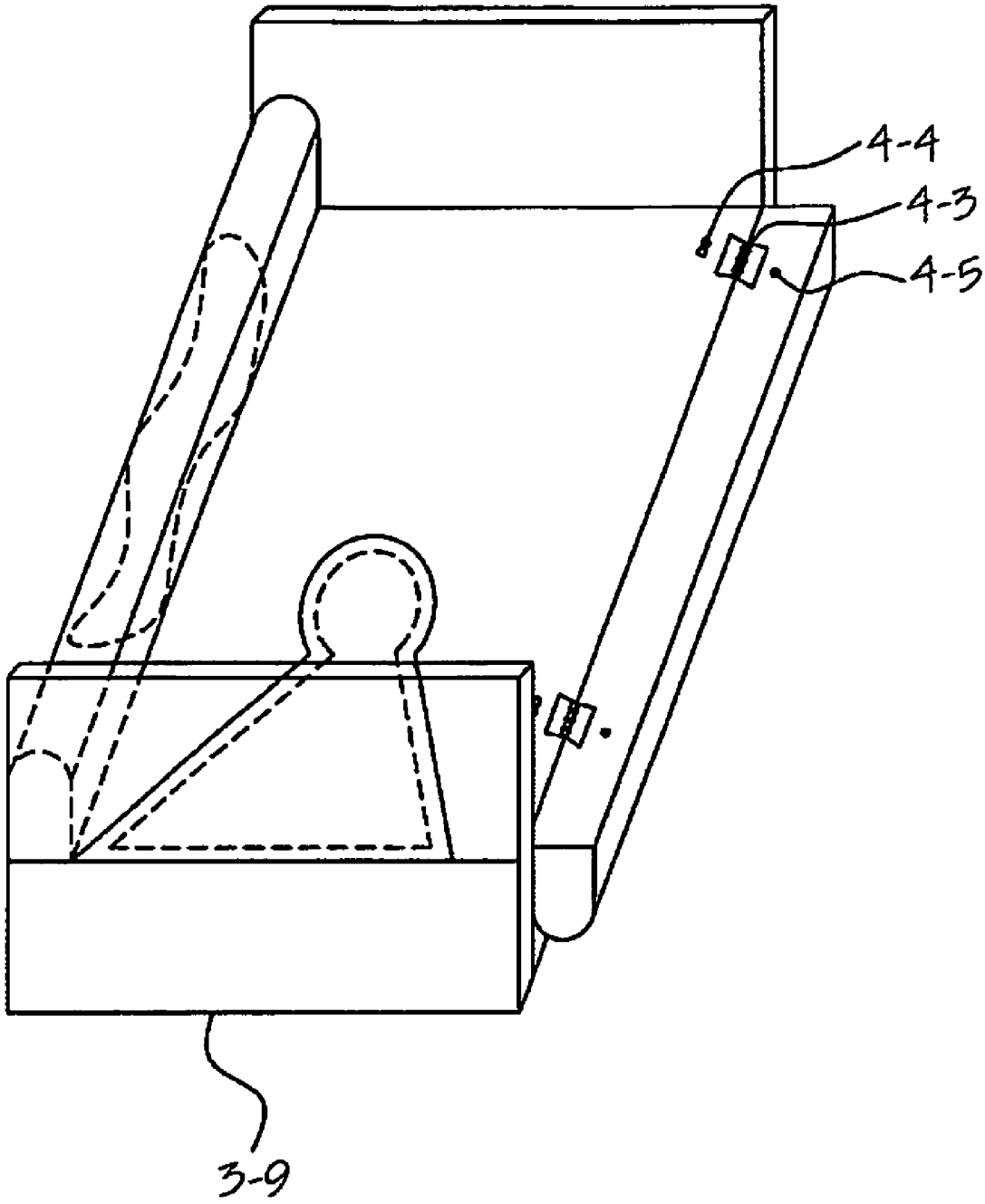
FIG. 7 is a schematic drawing of the bed according to current application when one of the side support is folded down.

FIG. 7 is a schematic drawing of the bed (1) according to current application when one of the side supports (4) is folded down.

U.S. Pat. No. 5,524,640 to Lisak, et al. illustrates an infant supporting and positioning system for retaining and supporting an infant in a selected position. The supporting system includes a horizontally oriented base which has a primary surface in which is formed a plurality of bores. The system includes a plurality of infant positioning modules each of which have a body portion and at least one post projecting from the body portion. The posts are sized and dimensioned for cooperative engagement with a corresponding one of the plurality of the bores in the base. But, the posts and bores are engagable only by straight up- and down motion. If a user tries to fold down the module aside, the posts will break down.

Therefore, it is clear that the bed according to current application not only provides a comfortable bed that prevents bed sores for invalids and sleep disturbing patient but also a comfortable sleeping aid bed for healthy users.

What is claimed is:

1. A comfortable bed for preventing bed sores for invalids and sleep disturbing patient is comprised of;

one head panel that is made of wood, and two side bottom frames which are made of wood and each of which has pluralities of protruding pins, which have a ball shape head mounted on a conical bottom, fixed on the upper surface thereof, and one foot panel that is made of wood and is comprised of two pieces that can be open from the center and one end of each piece is foldably attached to one of each side bottom frame via pluralities of hinges and the bottom portion of the foot panel touches the floor on which the bed is placed to support the foot portion of the bed firmly when the two pieces are closed, and two side support panels, each of which is comprised of a rigid wood portion; which has an upper surface curved as a smooth rounded wide "W" shape and has pluralities of grooves, each of which has a bore that has a ball shape head mounted on a conical bottom, which are developed on the lower surface there of and a soft resilient portion that is comprised of silicone rubber and has a lower surface that is curved as the same smooth rounded wide "W" shape of the solid wood portion to meet with the upper surface of the solid wood portion and has an upper surface which is flat along the length and rounded as hemi-circle along the width and outer side of each of the side support panel is connected to the side bottom frame with pluralities of hinges, and one wood bed plate, which has a key-hole shape groove at the foot portion thereof, and one removable key-hole shape panel that is engaged to the key-hole shape groove developed on the bed plate.

2. A comfortable bed preventing bed sores for invalids and sleep disturbing patient of claim 1, wherein the rubbery material for the soft resilient portion of the side support panel is urethane rubber.

3. A comfortable bed preventing bed sores for invalids and sleep disturbing patient of claim 1, wherein the side support panel is covered with leather.

* * * * *